US006958732B2

(12) United States Patent
Yuanzhu

(10) Patent No.: US 6,958,732 B2
(45) Date of Patent: Oct. 25, 2005

(54) SMALL-SIZED AND HIGH-GAINED ANTENNA-INTEGRATED MODULE

(75) Inventor: Dou Yuanzhu, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/859,370

(22) Filed: Jun. 2, 2004

(65) Prior Publication Data

US 2004/0252064 A1 Dec. 16, 2004

(30) Foreign Application Priority Data

Jun. 10, 2003 (JP) ..... 2003-165180

(51) Int. Cl.[7] ..... H01Q 1/24
(52) U.S. Cl. ..... 343/702; 343/841; 343/872
(58) Field of Search ..... 343/700 MS, 702, 343/829, 841, 846, 872

(56) References Cited

U.S. PATENT DOCUMENTS 6,014,113 A * 1/2000 Orchard et al. ..... 343/841
6,133,886 A * 10/2000 Fariello et al. ..... 343/702
6,278,369 B2 * 8/2001 Smith et al. ..... 340/572.7
6,618,014 B2 * 9/2003 Stoiljkovic et al. ..... 343/702
6,850,196 B2 * 2/2005 Wong et al. ..... 343/702

FOREIGN PATENT DOCUMENTS

JP 2002-232221 8/2002
JP 2003-188620 7/2003

* cited by examiner

*Primary Examiner*—Tho Phan
(74) *Attorney, Agent, or Firm*—Brinks Hofer Gilson & Lione

(57) ABSTRACT

The antenna-integrated module contains a circuit board 1 on which a high frequency circuit is provided, a cover 2 that is composed of a metal plate and is mounted to the circuit board 1 so as to cover almost the entire surface of the circuit board 1, and a dedicated shield case 3 that is composed of a metal plate and is mounted to the circuit board 1 so as to cover a specific region on the circuit board 1. The high frequency circuit comprises a wiring pattern 4 and a ground pattern 5, and electronic parts 6, and the dedicated shield case 3 covers a portion of the high frequency circuit. Leg pieces 2*b* and 2*c* of the cover 2 are connected to the wiring pattern 4 and the ground pattern 5. In the cover 2, an upper plate 2*a* corresponding to a radiation conductor portion functions as both an inverted F-type antenna and a shield case.

5 Claims, 2 Drawing Sheets

SMALL-SIZED AND HIGH-GAINED ANTENNA-INTEGRATED MODULE

This application claims the benefit of priority to Japanese Patent Application No. 2003-165180, herein incorporated by reference.

BACKGROUND OF THE INVENTION

1. Field of the Invention

The present invention relates to an antenna-integrated module suitable for a small-sized transmitter-receiver used for communication and broadcasting.

2. Description of the Related Art

In recent years, accompanying with the development of wireless communication techniques, various electronic apparatuses or wireless cards in which small-sized transmitter-receiver units are mounted have been proposed. This kind of transmitter-receiver unit is an antenna-integrated high frequency module in which an antenna element is mounted on a circuit board with a high frequency circuit. In the conventional antenna-integrated module, in general, a shield case composed of a metal plate covers a specific region of the circuit board on which the main parts of the high frequency circuit are arranged. An antenna element, such as a chip antenna or a pattern antenna, is provided on the other regions of the circuit board, which is disclosed in Japanese Unexamined Patent Application Publication No. 2002-232221 (see pages 4 to 6 and FIG. 1).

In such a conventional antenna-integrated module, the high frequency circuit comprises a wiring pattern that is formed on the upper surface, etc., of the circuit board, various electronic parts, such as chip parts and ICs that are connected to the wiring pattern, and a ground pattern that is formed on the lower surface or in an inner layer of the circuit board. A part of the wiring pattern extends toward the outside of the shield case to be connected to a feeding portion of the antenna element. In addition, the ground pattern is connected to a ground portion of the antenna element through a via hole provided in the circuit board and is also connected to the shield case. Since the shield case is mounted to the circuit board in a state in which it covers the main parts of the high frequency circuit, the high frequency circuit is maintained in a state in which it is almost shielded from an electromagnetic field.

As described above, in the conventional antenna-integrated module, both the antenna element and the shield case are provided on the circuit board, and the shield case covers the main parts of the high frequency circuit. Therefore, although the shield case and the antenna element are arranged as close to each other as possible, the entire size of the module is a little large in plan view. Thus, it is difficult to decrease the size of the module. In addition, in the conventional antenna-integrated module, since the antenna element must be provided in limited space on the circuit board, the size of the antenna element itself is strictly restricted, and thus it is difficult to achieve an antenna-integrated module having a high gain. Furthermore, in the conventional antenna-integrated module, a space for the antenna element is small. Therefore, in order to obtain the desired electric field in the radiation conductor portion, an additional antenna element, such as a chip antenna, has to be mounted on the circuit board. As a result, the number of parts and manufacturing costs of the module are increased.

SUMMARY OF THE INVENTION

Accordingly, the present invention is designed to solve the above problems, and it is an object of the present invention to provide an antenna-integrated module having a small size, a high gain, and low manufacturing costs.

In order to achieve the above object, an antenna-integrated module of the present invention comprises: a circuit board on which a wiring pattern and a ground pattern of a high frequency circuit are formed and on which electronic parts of the high frequency circuit are mounted, and a cover including a radiation conductor portion that is provided so as to cover the upper side of the high frequency circuit, and a feeding conductor portion and a ground conductor portion that extend from the radiation conductor portion, the cover being mounted to the circuit board, wherein the feeding conductor portion is connected to the wiring pattern, and the ground conductor portion is connected to the ground pattern, and wherein the feeding conductor portion, the ground conductor portion, and the radiation conductor portion constitute an antenna element, and the antenna element is an inverted F-type antenna.

In the antenna-integrated module in which a conductor portion of the cover that covers the main parts of the high frequency circuit and is connected to the ground functions as an antenna element, since the conductor portion of the cover can almost shield the high frequency circuit from an electromagnetic field, it is not necessary to provide both the antenna element and the shield case on the circuit board. That is, in the antenna-integrated module of the present invention, since the antenna element also functions as the shield case, it is possible to remarkably decrease the entire size of the module and thus to decrease the number of parts thereof, thereby reducing manufacturing costs thereof. In addition, since an antenna element having almost the same size as the circuit board can be used, it is possible to achieve an antenna-integrated module having a high gain.

In the antenna-integrated module having the above structure, the cover may be composed of a metal plate or may be formed by providing a conductive layer on the surface of a box-shaped case made of synthetic resin. For example, when the cover is formed of a metal plate comprising an upper plate that is disposed opposite to the circuit board, and a plurality of leg pieces that is bent with respect to the upper plate, the upper plate can be used as the radiation conductor portion, and the plurality of leg pieces can be used as the feeding conductor portion and the ground conductor portion. In addition, when the cover is formed by providing the conductive layer on the surface of the box-shaped case made of synthetic resin, the conductive layer provided on the upper plate of the box-shaped case can be used as the radiation conductor portion, and the conductive layer provided on a side wall of the box-shaped case can be used as the feeding conductor portion and the ground conductor portion.

Furthermore, when the high frequency circuit comprises components, such as an amplifying circuit unit and an oscillating circuit unit, in which a high shield effect is required, it is preferable that a dedicated shield case composed of a metal plate be mounted to the circuit board so as to cover the components and that the radiation conductor portion of the antenna element be arranged on the upper side of the shield case.

Moreover, when the ground pattern of the high frequency circuit is formed on the lower surface or in an inner layer (in the case of a multi-layered board) of the circuit board, it is possible to use the ground pattern as another electrode of the antenna, and thus to easily secure the wide area of the electrode.

DESCRIPTION OF THE PREFERRED EMBODIMENTS

Figure 1:
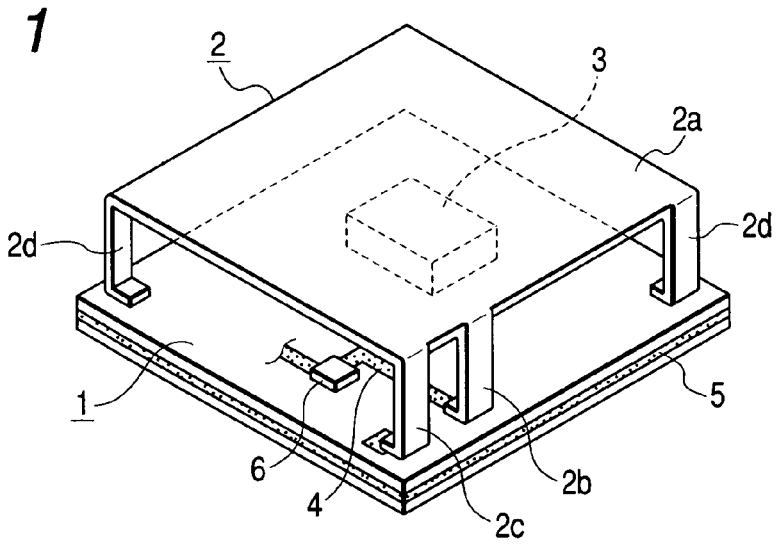
FIG. 1 is a perspective view of an antenna-integrated module according to a first embodiment of the present invention.
Figure 2:
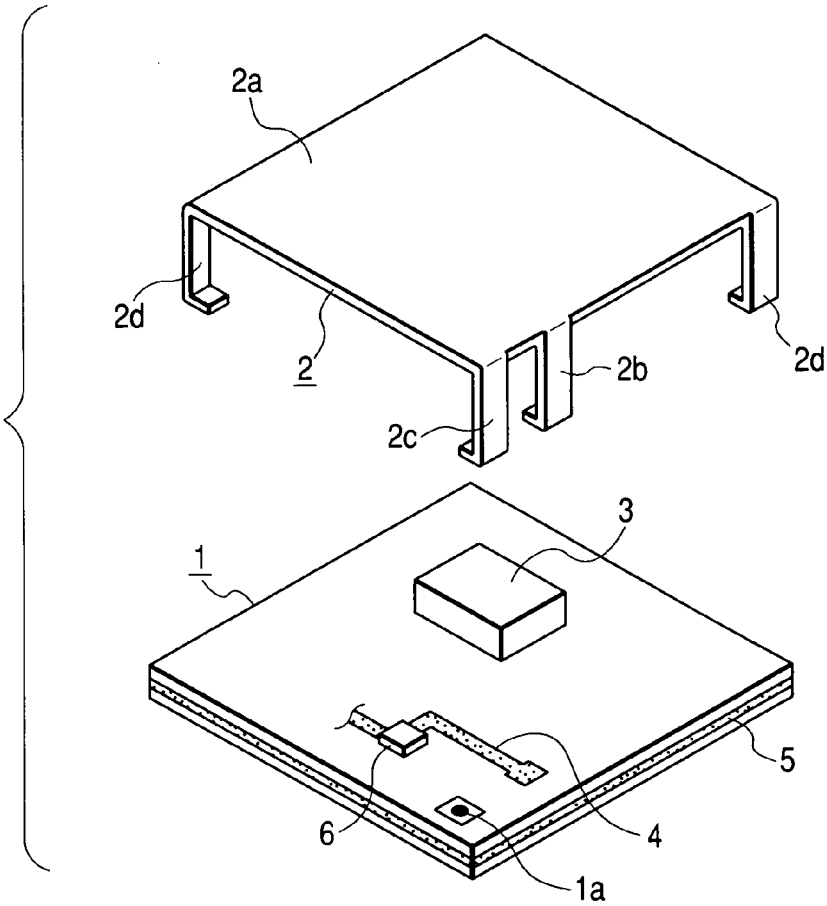
FIG. 2 is an exploded perspective view of the antenna-integrated module shown in FIG. 1.

Hereinafter, embodiments of the present invention will be described with reference to the accompanying drawings. FIG. 1 is a perspective view of an antenna-integrated module according to a first embodiment of the present invention, and FIG. 2 is an exploded perspective view of the antenna-integrated module.

The antenna-integrated module shown in the drawings comprises a circuit board 1 on which a high frequency circuit is arranged, a cover 2 that is composed of a metal plate and is mounted to the circuit board 1 so as to cover almost the entire surface thereof, and a dedicated shield case 3 that is composed of a metal plate and is mounted to the circuit board 1 so as to cover a specific region thereon. The high frequency circuit of the module comprises a wiring pattern 4 formed on the upper surface and lower surface of the circuit board 1, which is a multi-layered board, a ground pattern 5 formed on an inner layer of the circuit board 1, and various electronic parts 6, such as chip parts and ICs, which are mounted on the upper surface and the lower surface of the circuit board 1 to connect to the wiring patterns 4. In addition, of components constituting the high frequency circuit, an amplifying circuit unit or an oscillating circuit unit, requiring a high shield effect, is covered with the dedicated shield case 3.

The cover 2 comprises an upper plate 2*a* that is arranged parallel to and opposite to the circuit board 1, and a plurality of leg pieces 2*b*, 2*c*, and 2*d* that is bent at a substantially right angle with respect to the upper plate 2*a*. The dedicated shield case 3 is mounted to the circuit board 1, and the cover 2 is then mounted to the circuit board 1 by soldering the leg pieces 2*b* to 2*d* to lands on the circuit board 1, respectively. At this time, the leg piece 2*b* is connected to a feeding line of the wiring pattern 4, the leg piece 2*c* is connected to the ground pattern 5 through a via hole 1*a* in the circuit board 1, and the leg pieces 2*d* are connected to dummy lands which are electrically isolated. In short, the cover 2 has the same structure as an inverted F-type sheet metal antenna. That is, the upper plate 2*a* functions as a radiating conductor portion, the leg piece 2*b* functions as a feeding conductor portion, and the leg piece 2*c* functions as a ground conductor portion. Furthermore, since the cover 2 composed of a metal plate is connected to the ground pattern 5, it may act as a shield case covering the main parts of the high frequency circuit. In addition, the leg pieces 2*d* other than the leg pieces 2*b* and 2*c* of the cover 2 enable the cover 2 to be reliably mounted to the circuit board 1.

In the antenna-integrated module according to the present embodiment, since the cover 2 that is composed of a metal plate and covers the main parts of the high frequency circuit functions as both an inverted F-type antenna and a shield case for shielding the high frequency circuit from an electromagnetic field, it is not necessary to provide both an antenna element and a shield case on the circuit board. That is, in the antenna-integrated module of the present embodiment, since the antenna element also functions as the shield case, the number of parts and manufacturing costs of the module are reduced, and thus the entire size of the module is remarkably decreased. In addition, the radiation conductor portion (the upper plate) 2*a* of the cover 2 has the same size as the circuit board 1 in plan view, and the size of the antenna element is not extremely small. Therefore, the module can have a high gain.

Furthermore, it is necessary to strictly shield the amplifying circuit unit or the oscillating circuit unit of the high frequency circuit. However, only the cover 2 may not completely shield them. Therefore, the dedicated shield case 3 according to the present embodiment is additionally provided to settle the problem of the insufficient shield. However, in the case of a high frequency circuit without components requiring a strict shield effect, since only the cover 2 completely shields the circuit, the dedicated shield case 3 can be omitted.

Figure 3:
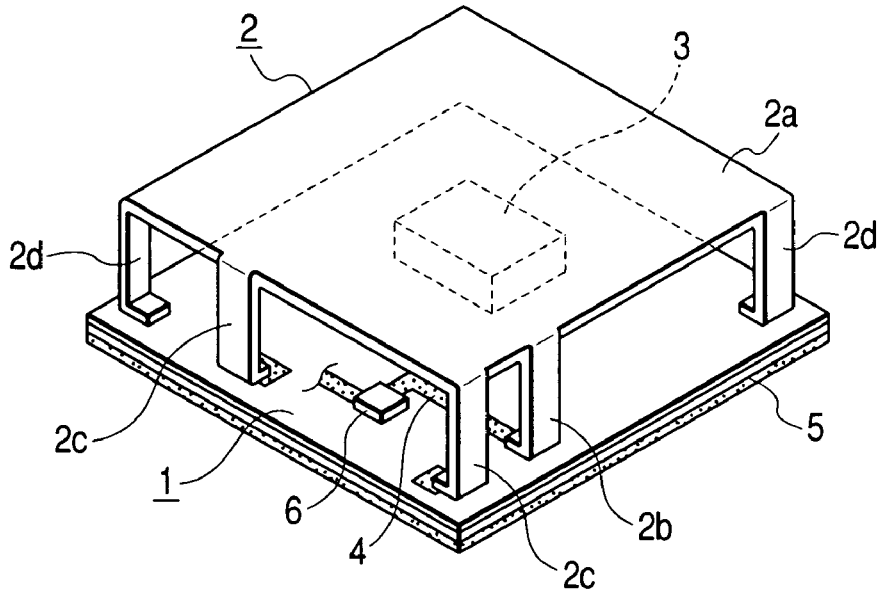
FIG. 3 is a perspective view of an antenna-integrated module according to a second embodiment of the present invention.

FIG. 3 is a perspective view of an antenna-integrated module according to a second embodiment of the present invention. In FIG. 3, the same components as those in FIGS. 1 and 2 have the same reference numerals.

The second embodiment is largely different from the first embodiment in that two leg pieces 2*c* functioning as ground conductor portions are provided on the cover 2, and the distance from one leg piece 2*c* to the leg piece 2*b* functioning as the feeding conductor portion is different from the distance from the other leg piece 2*c* to the leg piece 2*b*. As a result, it is possible to make the cover 2 function as an antenna element having a wider bandwidth than that of a conventional inverted F-type antenna. In addition, according to the present embodiment, the ground pattern 5 is formed on the lower surface of the circuit board 1.

Figure 4:
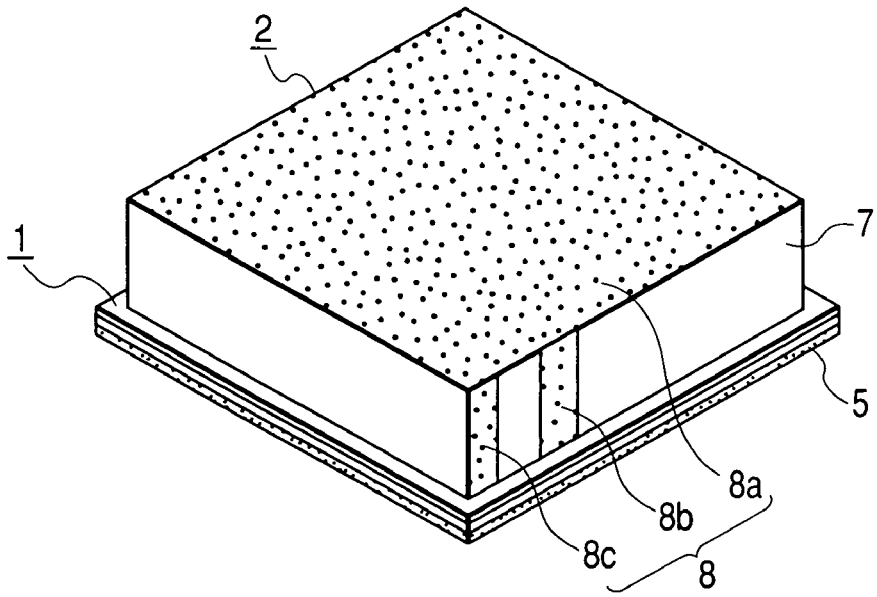
FIG. 4 is a perspective view of an antenna-integrated module according to a third embodiment of the present invention.

FIG. 4 is a perspective view of an antenna-integrated module according to a third embodiment of the present invention. In FIG. 4, the same components as those in FIGS. 1 to 3 have the same reference numerals.

The third embodiment is greatly different from the first and second embodiments in that the cover 2 is not composed of a metal plate but is formed by providing a conductive layer 8 on the surface of a box-shaped case 7 made of synthetic resin, an upper plate coating portion 8*a* of the conductive layer 8 that is provided over the entire surface of an upper plate portion of the box-shaped case 7 functions as the radiation conductor portion, and a pair of strip-shaped portions 8*b* and 8*c* that is provided on a side wall of the box-shaped case 7 functions as the feeding conductor portion and the ground conductor portion, respectively. In addition, similar to the second embodiment, the ground pattern 5 is formed on the lower surface of the circuit board 1 in the present embodiment.

According to the embodiments of the present invention constituted as described above, the following effects are obtained.

By making the conductor portion of the cover that covers the main parts of the high frequency circuit and is connected to the ground function as the antenna element, the antenna element also functions as the shield case. Therefore, it is possible to remarkably miniaturize the antenna-integrated module and to reduce the number of parts thereof, thereby reducing manufacturing costs. In addition, since the antenna element having almost the same size as the circuit board can be used, the gain thereof can be increased.

What is claimed is:

1. An antenna-integrated module, comprising:

a circuit board on which a wiring pattern and a ground pattern of a high frequency circuit are formed and on which electronic parts of the high frequency circuit are mounted, and a cover including a radiation conductor portion that is provided so as to cover an upper side of the high frequency circuit, and a feeding conductor portion and a ground conductor portion that extend from the radiation conductor portion, the cover being mounted to the circuit board, wherein the feeding conductor portion is connected to the wiring pattern, and the ground conductor portion is connected to the ground pattern, and wherein the feeding conductor portion, the ground conductor portion, and the radiation conductor portion constitute an antenna element, and the antenna element is an inverted F-type antenna.

2. The antenna-integrated module according to claim 1, further comprising a shield case that is provided between the radiation conductor portion and the circuit board and that is mounted to the circuit board, wherein the shield case covers a portion of the high frequency circuit.

3. The antenna-integrated module according to claim 1, wherein the ground pattern is formed on a lower surface or in an inner layer of the circuit board.

4. The antenna-integrated module according to claim 1, wherein the cover is composed of a metal plate having an upper plate that is disposed opposite to the circuit board and a plurality of leg pieces that is bent with respect to the upper plate, and wherein the upper plate is used as the radiation conductor portion, and the plurality of leg pieces is used as the feeding conductor portion and the ground conductor portion.

5. The antenna-integrated module according to claim 1, wherein the cover is formed by providing a conductive layer on a surface of a box-shaped case made of synthetic resin, and wherein the conductive layer provided on an upper plate of the box-shaped case is used as the radiation conductor portion, and the conductive layer provided on a side wall of the box-shaped case is used as the feeding conductor portion and the ground conductor portion.

* * * * *